US009964378B1

(12) United States Patent
Williams et al.

(10) Patent No.: US 9,964,378 B1
(45) Date of Patent: May 8, 2018

(54) T-HANDLE FIREARM CLEANING TOOL

(71) Applicant: Otis Products, Inc., Lyons Falls, NY (US)

(72) Inventors: Nicholas Williams, Naples, FL (US); Nathan Williams, Naples, FL (US)

(73) Assignee: Otis Products, Inc., Lyons Falls, NY (US)

( * ) Notice: Subject to any disclaimer, the term of this patent is extended or adjusted under 35 U.S.C. 154(b) by 0 days. days.

(21) Appl. No.: 15/348,535

(22) Filed: Nov. 10, 2016

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 29/00; B08B 9/0436
USPC ..... 42/95, 90; 15/104.2, 104.16
See application file for complete search history.

(56) References Cited

U.S. PATENT DOCUMENTS 2,798,238 A * 7/1957 Rogovin ..... F41A 29/02 15/104.16
3,064,294 A * 11/1962 Stocking ..... F41A 29/02 15/104.19
3,208,302 A * 9/1965 Lewis ..... F41A 29/02 15/104.16
4,399,627 A * 8/1983 Malesky ..... F41A 29/02 15/104.16
4,716,673 A * 1/1988 Williams ..... F41A 29/02 15/104.16
5,836,099 A * 11/1998 Pace ..... F41A 29/02 42/90
5,934,000 A * 8/1999 Hayes, Sr. ..... F41A 29/02 15/104.2
6,154,913 A * 12/2000 Burton ..... A47K 11/10 15/104.2
6,378,236 B1 * 4/2002 Solberg ..... F41A 29/02 15/104.165
6,701,658 B1 * 3/2004 Brownell ..... F41A 29/02 15/104.16
7,356,961 B2 4/2008 Williams
8,079,170 B2 * 12/2011 Loftin ..... F41A 29/02 15/104.03
D675,703 S * 2/2013 Buie, II ..... D22/108
8,371,057 B2 * 2/2013 Coffield, III ..... F41A 29/02 15/104.16
8,371,441 B2 2/2013 Williams
8,448,370 B2 5/2013 Williams
D683,810 S * 6/2013 Buie, II ..... D22/108
8,572,883 B2 * 11/2013 Markle ..... F41A 29/02 15/104.062

(Continued)

*Primary Examiner* — Michael D David
(74) *Attorney, Agent, or Firm* — Harris Beach PLLC

(57) ABSTRACT

A T-handle firearm cleaning tool includes a T-handle firearm cleaning tool body having a first surface and a second surface opposite the first surface and a T-handle firearm cleaning tool body longitudinal axis. A flexible cable has a connector mechanically coupled to a first flexible cable end and a cleaning tool bit mechanically coupled to a second flexible cable end opposite the first flexible cable end. A tapered cavity is disposed in either of the first surface or the second surface, the tapered cavity having a tapered cavity long axis substantially perpendicular to the T-handle firearm cleaning tool body longitudinal axis. The connector and the cleaning tool bit are sized to interference fit in the tapered cavity and the tapered cavity sized to capture the connector or the cleaning tool bit in the tapered cavity.

16 Claims, 22 Drawing Sheets

(56) References Cited

U.S. PATENT DOCUMENTS

| | | | | |
|---|---|---|---|---|
| D696,741 | S * | 12/2013 | Buie, II | D22/108 |
| 8,607,494 | B2 | 12/2013 | Shipman et al. | |
| 8,616,367 | B2 | 12/2013 | Williams | |
| 8,800,191 | B2 * | 8/2014 | Williams | F41A 29/02 15/104.2 |
| 8,925,235 | B2 * | 1/2015 | Buie, II | F41A 29/02 42/90 |
| 8,943,731 | B2 * | 2/2015 | Niebling | F41A 29/02 15/104.05 |
| 9,057,575 | B2 * | 6/2015 | Shipman | F41A 29/02 |
| 9,115,945 | B2 | 8/2015 | Williams et al. | |
| 9,115,947 | B2 | 8/2015 | Williams et al. | |
| 9,291,419 | B2 * | 3/2016 | Shipman | B08B 9/0436 |
| 9,366,496 | B2 * | 6/2016 | Hwang | F41A 29/02 |
| 9,851,168 | B2 * | 12/2017 | Hwang | F41A 29/02 |
| 2003/0136044 | A1 * | 7/2003 | Williams | F41A 29/00 42/95 |
| 2006/0010753 | A1 * | 1/2006 | Buie | F41A 29/02 42/95 |
| 2011/0047853 | A1 * | 3/2011 | Williams | F41A 29/02 42/95 |
| 2013/0091753 | A1 * | 4/2013 | Rogers | F41A 29/02 42/95 |
| 2016/0223282 | A1 | 8/2016 | Brooker | |
| 2016/0223283 | A1 | 8/2016 | Brooker | |
| 2016/0223284 | A1 | 8/2016 | Brooker et al. | |

* cited by examiner

T-HANDLE FIREARM CLEANING TOOL

FIELD OF THE APPLICATION

The application relates to firearm cleaning tools, and particularly to a T-handle based firearm cleaning tool and tool kit.

BACKGROUND

Timely and proper cleaning of firearms is a fundamental aspect of firearm ownership, use, and care. To that end, firearm cleaning kits are important for maintaining a good working operating condition of the firearm. Such cleaning kits are used in a wide range of settings from the armory workbench, a gunsmith's bench, a home table, to field use in both civilian (recreational and law enforcement use) and military use.

SUMMARY

According to one aspect, a T-handle firearm cleaning tool includes a T-handle firearm cleaning tool body having a first surface and a second surface opposite the first surface and a T-handle firearm cleaning tool body longitudinal axis. A flexible cable has a connector mechanically coupled to a first flexible cable end and a cleaning tool bit mechanically coupled to a second flexible cable end opposite the first flexible cable end. A tapered cavity is disposed in either of the first surface or the second surface, the tapered cavity having a tapered cavity long axis substantially perpendicular to the T-handle firearm cleaning tool body longitudinal axis. The connector and the cleaning tool bit are sized to interference fit in the tapered cavity and the tapered cavity sized to capture the connector or the cleaning tool bit in the tapered cavity.

In one embodiment, the tapered cavity includes a tapered cavity opening in each of two side surfaces of the T-handle firearm cleaning tool body.

In another embodiment, the tapered cavity further includes a ridge or a ledge within the tapered cavity to substantially prevent motion of the flexible cable or rod connector past the ridge or ledge in at least one of a pull or push direction.

In yet another embodiment, the T-handle firearm cleaning tool body includes at least one T-handle firearm tool bit cavity having an opening sized to store a tool bit in the T-handle firearm cleaning tool body.

In yet another embodiment, the T-handle firearm cleaning tool further includes at least one band encircling the T-handle firearm cleaning tool body over the opening of the at least one T-handle firearm tool bit cavity.

In yet another embodiment, the T-handle firearm cleaning tool body further includes at least one channel and at least O-ring is captured within the at least one channel and encircles the T-handle firearm cleaning tool body over the opening of the at least one T-handle firearm tool bit cavity to secure the tool bit into the T-handle firearm tool bit cavity.

In yet another embodiment, the T-handle firearm cleaning tool body includes an undercut molded tool bit cavity.

In yet another embodiment, the T-handle firearm cleaning tool body includes four T-handle firearm tool bit cavities on either end of each of two sides of the T-handle firearm cleaning tool body, each tool bit cavity having an opening sized to store a tool bit at each corner of four corners of the T-handle firearm cleaning tool body.

In yet another embodiment, the T-handle firearm cleaning tool body includes at least one T-handle firearm tool bit receptacle to interchangeably accept tool bits.

In yet another embodiment, the T-handle firearm tool bit receptacle includes a hex tool bit receptacle.

In yet another embodiment, the connector includes a threaded connector crimped onto the flexible cable.

In yet another embodiment, the cleaning tool bit includes a slotted bit which accepts a cleaning swab or a cleaning patch.

In yet another embodiment, the T-handle firearm cleaning tool includes at least four tool bit cavities disposed near each of four corners of the T-handle firearm cleaning tool body. Each cavity is disposed respectively in a forward first side surface, a rear first side surface, a forward second side surface, a rear second side surface. Each tool bit cavity is also open to first and second ends of the T-handle firearm cleaning tool body.

In yet another embodiment, the tool bit cavity is disposed in an end surface of at least two end surfaces of the T-handle firearm cleaning tool body.

In yet another embodiment, the T-handle firearm cleaning tool further includes a female threaded socket in at least one surface of the T-handle firearm cleaning tool body to accept a male threaded rod end of a cleaning rod.

In yet another embodiment, the cleaning rod further includes a female threaded receptacle at an end of the cleaning rod opposite the male threaded rod end to accept a cleaning tool bit.

In yet another embodiment, the cleaning tool bit includes a brush or an obstruction remover bit.

According to another aspect, a T-handle firearm cleaning tool kit includes a T-handle firearm cleaning tool body having a top surface, a bottom surface, at least two end surfaces, and at least two side surfaces. The T-handle firearm cleaning tool body includes at least one tool bit having a tool bit base. At least one T-handle firearm cleaning tool bit cavity has an opening about a length of the tool bit. At least one band encircles the T-handle firearm cleaning tool body over an opening of the at least one T-handle firearm cleaning tool bit cavity. At least one tool bit receptacle is disposed in a surface of the T-handle firearm cleaning tool body, the at least one tool bit receptacle sized to accept the tool bit base. The T-handle firearm cleaning tool kit also includes a flexible cable. A connector or a cleaning tool tip is mechanically coupled to a first end of the flexible cable. A tapered cavity is disposed in either of the top surface or the bottom surface. The tapered cavity has a long tapered cavity axis substantially perpendicular to a longitudinal axis of the T-handle firearm cleaning tool body and a tapered cavity opening in each of two side surfaces to capture the connector or the cleaning tool tip in at least one of a pull or push direction.

According to yet another aspect, a method to clean a firearm includes threading a connector or a cleaning tool bit affixed to a first end of a flexible cable through a first end of a bore of a firearm so that the flexible cable emerges from a second end of the bore of the firearm, a working cleaning tool or tool bit affixed to the flexible cable opposite the first end; inserting and capturing the connector or the cleaning tool bit into a tapered cavity disposed in either of a top surface or a bottom surface of a T-handle firearm cleaning tool body; and pulling the cleaning tool bit through the bore of the firearm by pulling on the T-handle firearm cleaning tool body.

In one embodiment, the step of capturing the connector or cleaning tool bit in a tapered cavity further including capturing the connector or cleaning tool bit against a ledge or ridge of an inner wall of the tapered cavity.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

A T-handle has been used with a firearm cleaning tools and tool bits. For example, an exemplary slim profile T-handle was disclosed in U.S. Pat. No. 8,607,494 B2 "FIREARM PULL-THROUGH CLEANING TOOL WITH INTEGRATED FOLDABLE HANDLE," assigned to the common assignee of this application, which '494 patent is hereby incorporated by reference in its entirety for all purposes.

Cleaning bits for cleaning firearms have also been described, such as, for example, in U.S. Pat. No. 7,356,961 B2, CONFIGURABLE DEVICE FOR CLEANING THE BARREL OF A FIREARM, AND FIREARM CLEANING KIT CONTAINING COMPONENTS OF DEVICE; U.S. Pat. No. 8,448,370 B2, QUICK RELEASE CONNECTOR FOR FIREARM CLEANING KIT AND METHOD FOR USING THE SAME; U.S. Pat. No. 8,616,367 B2, MODULAR FIREARM CLEANING KIT CASE, and U.S. Pat. No. 8,707,607 B2, GUN CLEANING TOOL KIT; U.S. Pat. No. 8,371,441 B2, ATTACHMENT ELEMENT FOR A GUN CLEANING KIT TOOL INSERT, all of the above patents assigned to the common assignee of this application, the '961, '370, '367, '607, and '441 patents are hereby incorporated by reference in its entirety for all purposes.

Other types of pull through gun cleaning devices have been described, such as, for example, in U.S. Pat. No. 9,115,945 B2, APPARATUS AND METHOD FOR CLEANING THE BARREL OF A FIREARM, and U.S. Pat. No. 9,115,947 B2, APPARATUS AND METHOD FOR CLEANING THE BARREL OF A FIREARM, co-pending U.S. patent application Ser. No. 15/013,309, MANDREL BASED HELICAL PULL THROUGH GUN CLEANING DEVICE, filed Feb. 2, 2016, co-pending U.S. patent application Ser. No. 15/013,282, HELICALLY WOUND PULL THROUGH GUN CLEANING DEVICE, and co-pending U.S. patent application Ser. No. 15/013,350, PULL THROUGH GUN CLEANING DEVICE WITH ONE OR MORE CYLINDRICAL DOUBLE CONED SHEATHED PRESSURE SECTIONS. All of the above named applications and patents including the '945, and '947 patents and '309, '282, and '350 applications are assigned to the common assignee of this application, and are incorporated herein by reference in their entirety for all purposes.

While optimal for many firearm cleaning applications and tasks, the firearm cleaning tools listed hereinabove could still be more compact.

What is needed is a new type of more compact firearm cleaning tool which combines the advantages of a cable and/or rod based T Handle cleaning system.

Figure 1:
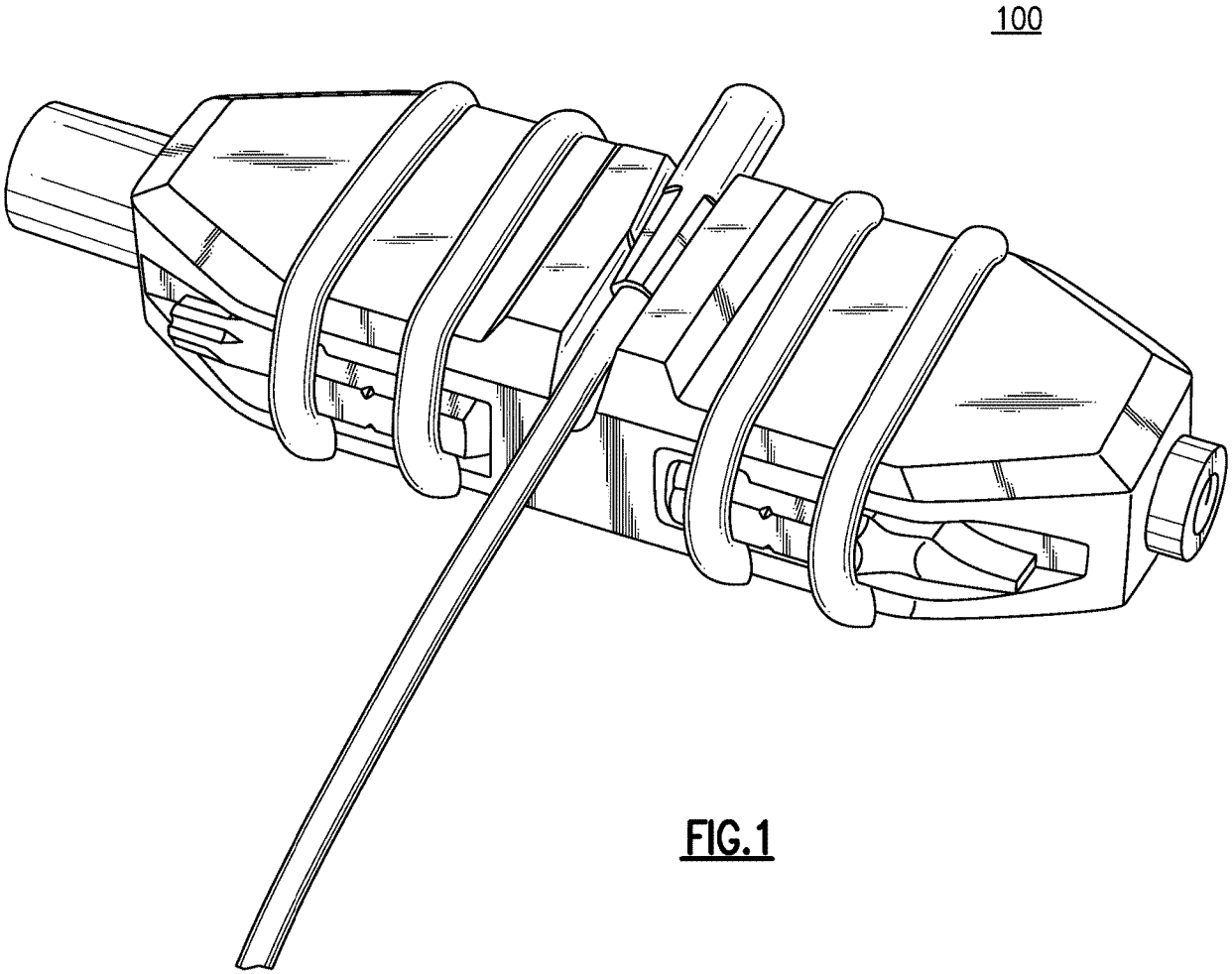
FIG. 1 shows a close up drawing of an exemplary T-handle firearm cleaning tool.

FIG. 1 shows an exemplary embodiment of a new type of compact T-handle firearm cleaning tool 100 which can be relatively easy to manufacture, cost effective, and physically compact and easy to store, to transport, and to use in the field or at a table or workbench.

Figure 2:
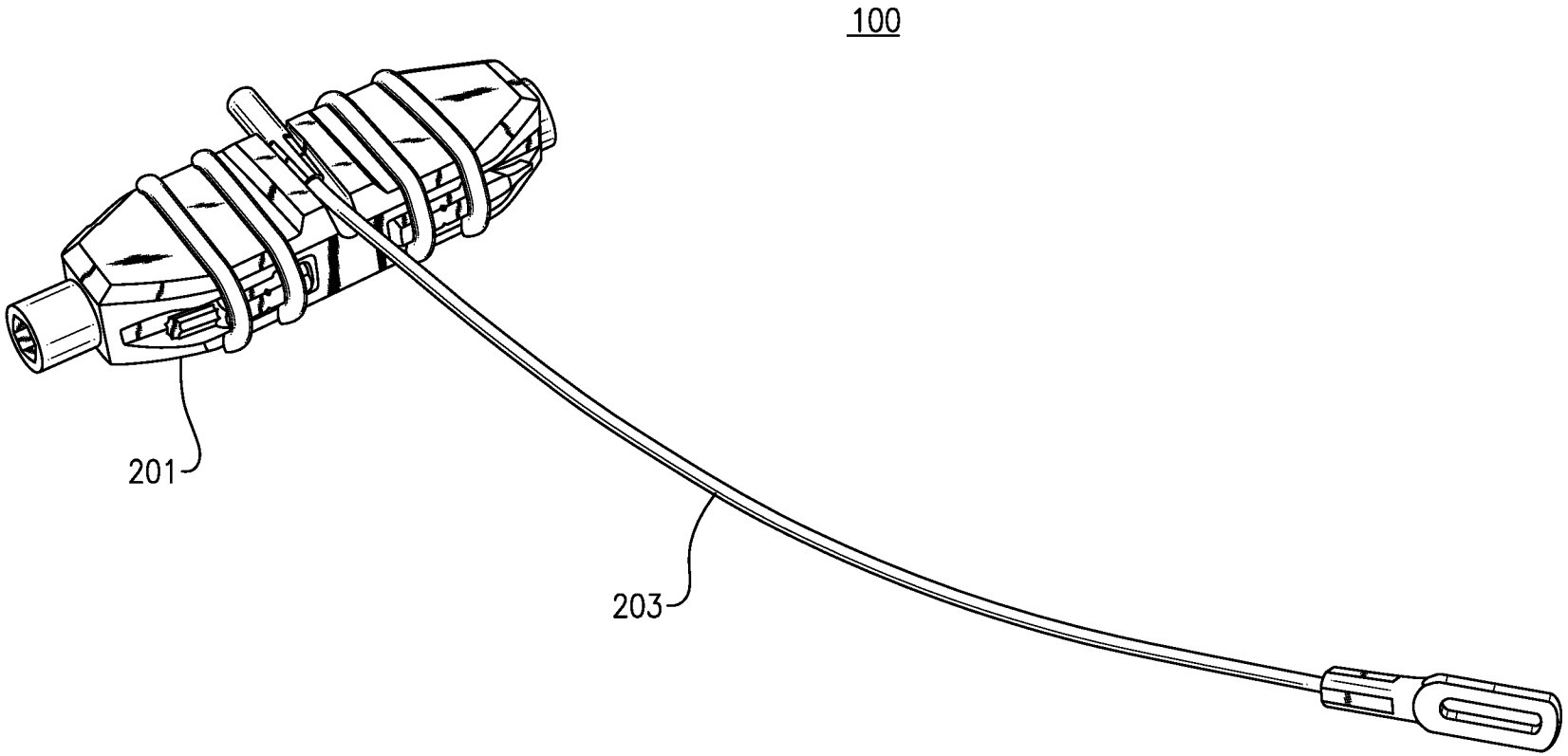
FIG. 2 shows a drawing of the T-handle firearm cleaning tool of FIG. 1 including a connector, a flexible cable, and a slotted tip.

FIG. 2 shows a drawing of the T-handle firearm cleaning tool of FIG. 1 including a connector, flexible cable, and an exemplary cleaning tip, a slotted tip. In one embodiment, the T-handle firearm cleaning tool body 201 has a first surface 251, and a second surface 253 (FIG. 17, FIG. 18) opposite said first surface and a T-handle firearm cleaning tool body longitudinal axis.

Figure 3:
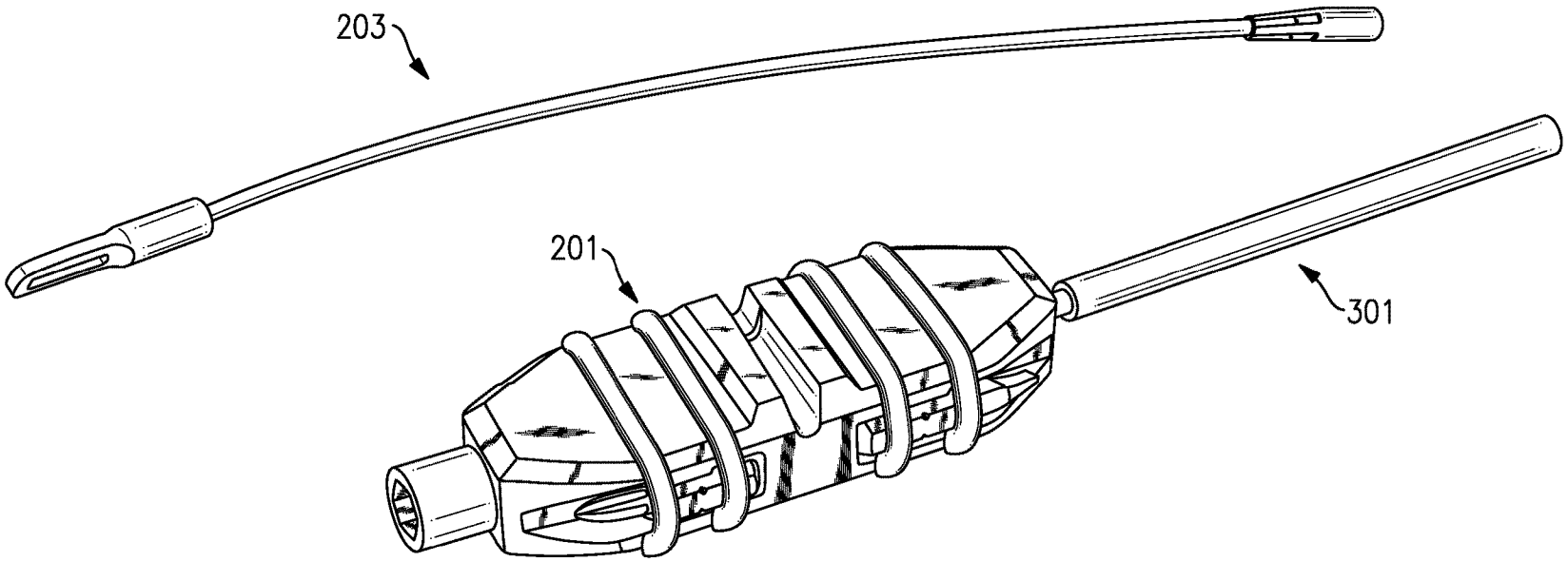
FIG. 3 shows a drawing of the T-handle firearm cleaning tool of FIG. 1 including a threaded rod.

FIG. 3 shows a drawing of the T-handle firearm cleaning tool of FIG. 1 including a threaded rod 301. For reference, the T-handle firearm cleaning tool body longitudinal axis is in line with the long direction of the rod 301.

Figure 4:
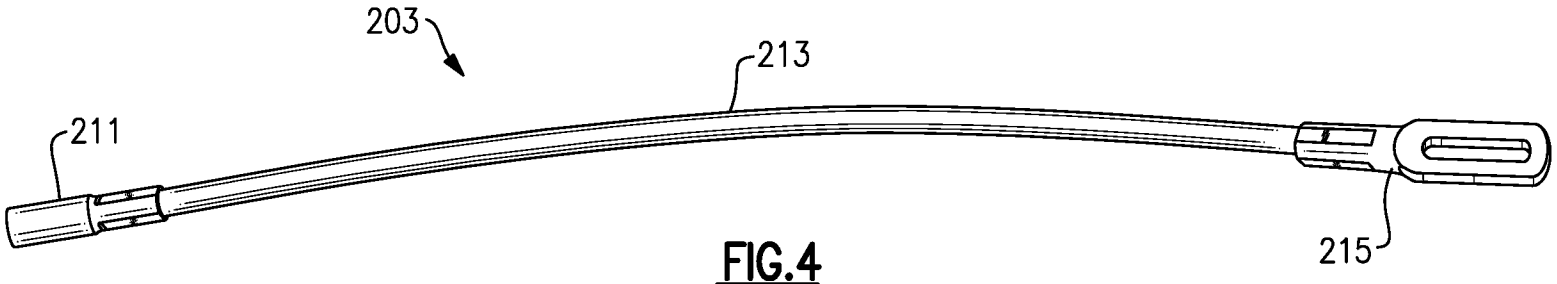
FIG. 4 shows a drawing of a cable assembly including a connector, a flexible cable, and a slotted tip.

FIG. 4 shows a drawing of a cable assembly 203 including a connector 211, a flexible cable 213, and a slotted tip 215. Connector 211 is mechanically coupled to a first flexible cable 213 end and a cleaning tool bit (e.g. slotted tip 215) is mechanically coupled to a second flexible 213 cable end.

A tapered cavity 291 (FIG. 19) is disposed in either of the first surface 251 or the second surface 253. The tapered cavity 291 has a tapered cavity long axis substantially perpendicular to the T-handle firearm cleaning tool body longitudinal axis. The connector 211 and the cleaning bit are sized to interference fit in the tapered cavity 291. Tapered cavity 291 is sized to capture the connector 211 or the cleaning tool bit (e.g. slotted tip 215) in the tapered cavity 291.

Figure 5:
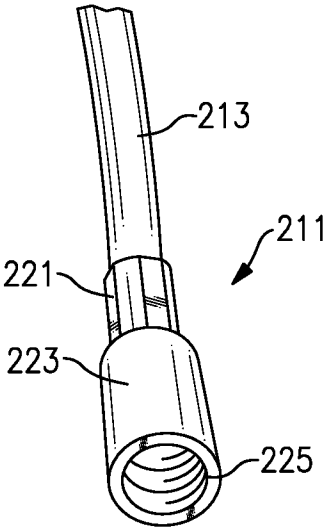
FIG. 5 shows a drawing of an exemplary female threaded end of a connector crimped onto the flexible cable.

FIG. 5 shows a drawing of an exemplary female threaded end 223 (threads 225) of a connector 211 crimped onto the flexible cable by crimp section 221.

Figure 6:
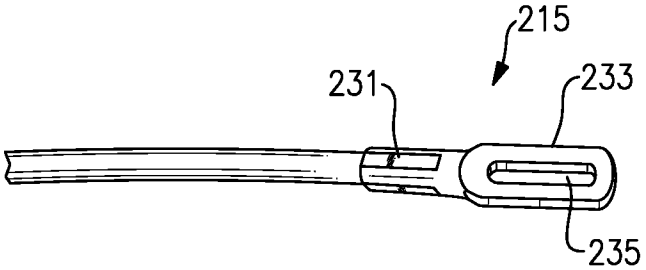
FIG. 6 shows a drawing an exemplary slotted tip crimped onto the flexible cable.

FIG. 6 shows a drawing an exemplary cleaning tip, a cleaning tool bit, slotted tip 215 crimped onto the flexible cable 213. Slotted tip 215 is crimped onto cable 213 by crimp section 231. The slot opening 235 is defined by slotted section 233. Typically, a circular swab has a central slot opening through which slotted section 233 is passed. Then part of the swab is pull through the slot opening 235 to prepared the swab to be pull through the bore of a firearm for a cleaning operation. Any suitable solvents or cleaning solutions can be applied to the swab to assist in removing contaminants during the cleaning operation. Any suitable swab or patch including a patch passed through the slot opening 235 can be used.

As was shown in FIG. 3, a rod 301 can be affixed to an end of the T-handle firearm cleaning tool body 201, for example, by threading a male threaded end of a rod into a female threaded receptacle mounted on or within the T-handle firearm cleaning tool body 201.

Figure 7A:
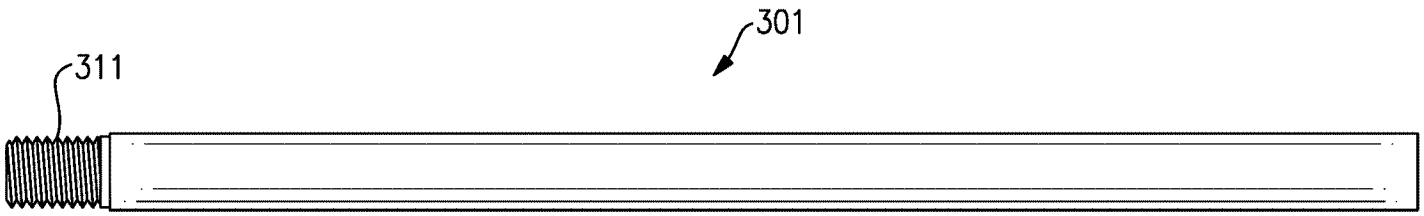
FIG. 7A shows a drawing of an exemplary rod with a male threaded end and a female threaded opposite end.
Figure 7B:
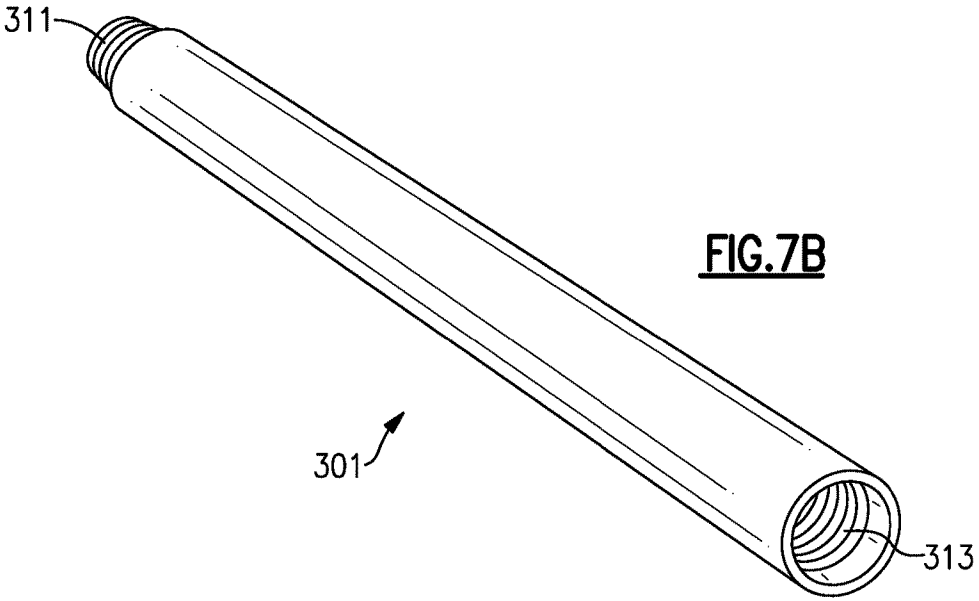
FIG. 7B shows a drawing of an exemplary rod illustrating the female threaded opposite end.

FIG. 7A shows a drawing of an exemplary suitable rod 301 with a male threaded end 311 and a female threaded opposite end 313. FIG. 7B shows a drawing of an exemplary rod 301 illustrating the female threaded opposite end 313 in more detail.

Figure 8:
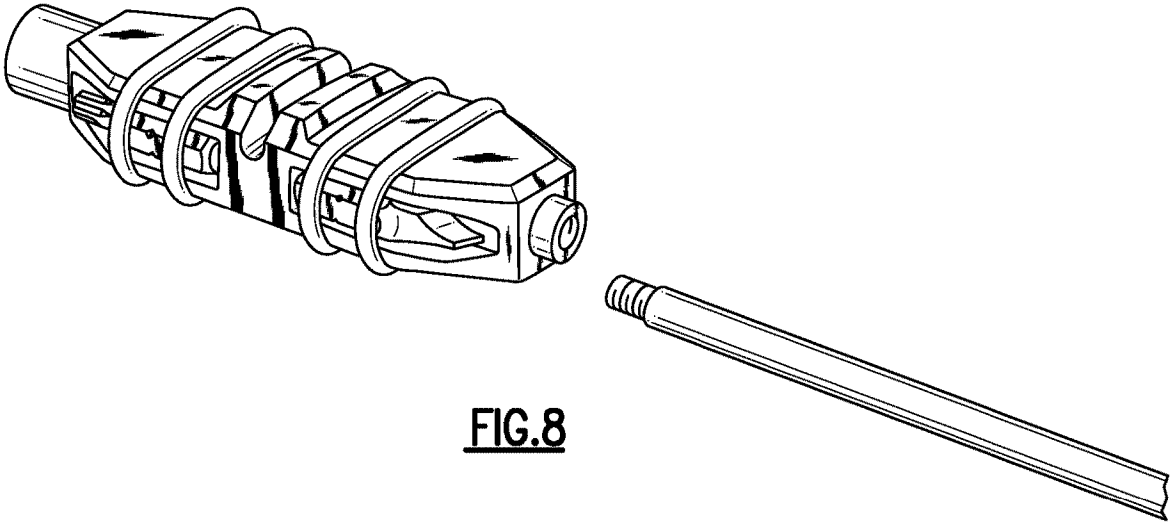
FIG. 8 shows a drawing of the rod of FIG. 7A illustrating how the rod threaded end couples to a threaded receptacle on an end of the T-handle firearm cleaning tool of FIG. 1.

FIG. 8 shows a drawing of the rod of FIG. 7A and FIG. 7B illustrating how the rod threaded end 311 couples to a threaded receptacle 233 on an end of the T-handle firearm cleaning tool body 201. In configurations such as the one illustrated by FIG. 8, T-handle firearm cleaning tool body 201 can serve as a tool handle.

Figure 9:
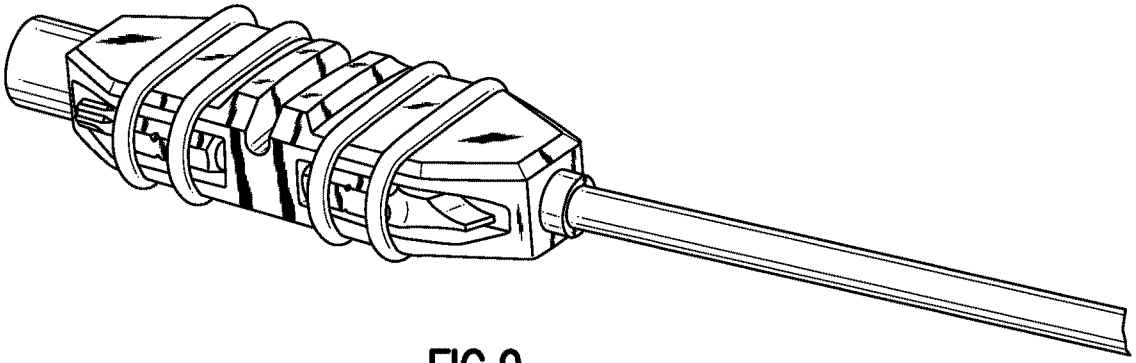
FIG. 9 shows a drawing of the rod of FIG. 8 illustrating the rod threaded end coupled to the threaded receptacle.

FIG. 9 shows how the rod threaded end 311 can be threadingly coupled (i.e. screwed into) to the threaded receptacle 233 on an end of the T-handle firearm cleaning tool body 201. In the configuration of FIG. 9, a cleaning tool tip can be threadingly coupled to the female threaded opposite end 313 of rod 301. For example, an obstruction remover tip can be used to remove foreign matter from any cavity of the firearm including the bore. Or, a brush, such as, for example, and wire brush can be attached to rod 301 for any cleaning operation performed by use of a brush.

Figure 10:
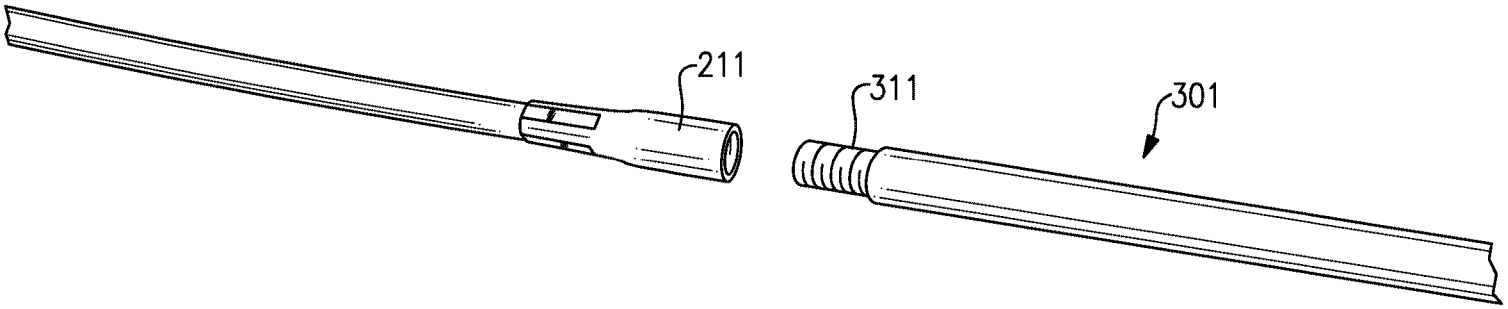
FIG. 10 shows a drawing of the end of the cable next to the rod of FIG. 7A.
Figure 11:
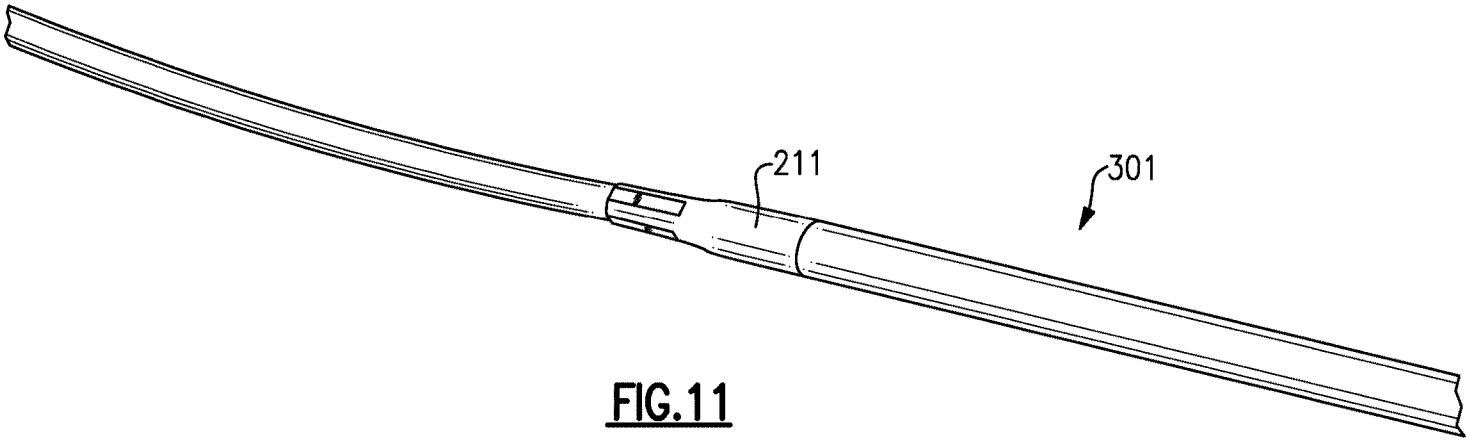
FIG. 11 shows a drawing of the connector at end of the cable threadingly coupled to the threaded end of the rod of FIG. 10.
Figure 12:
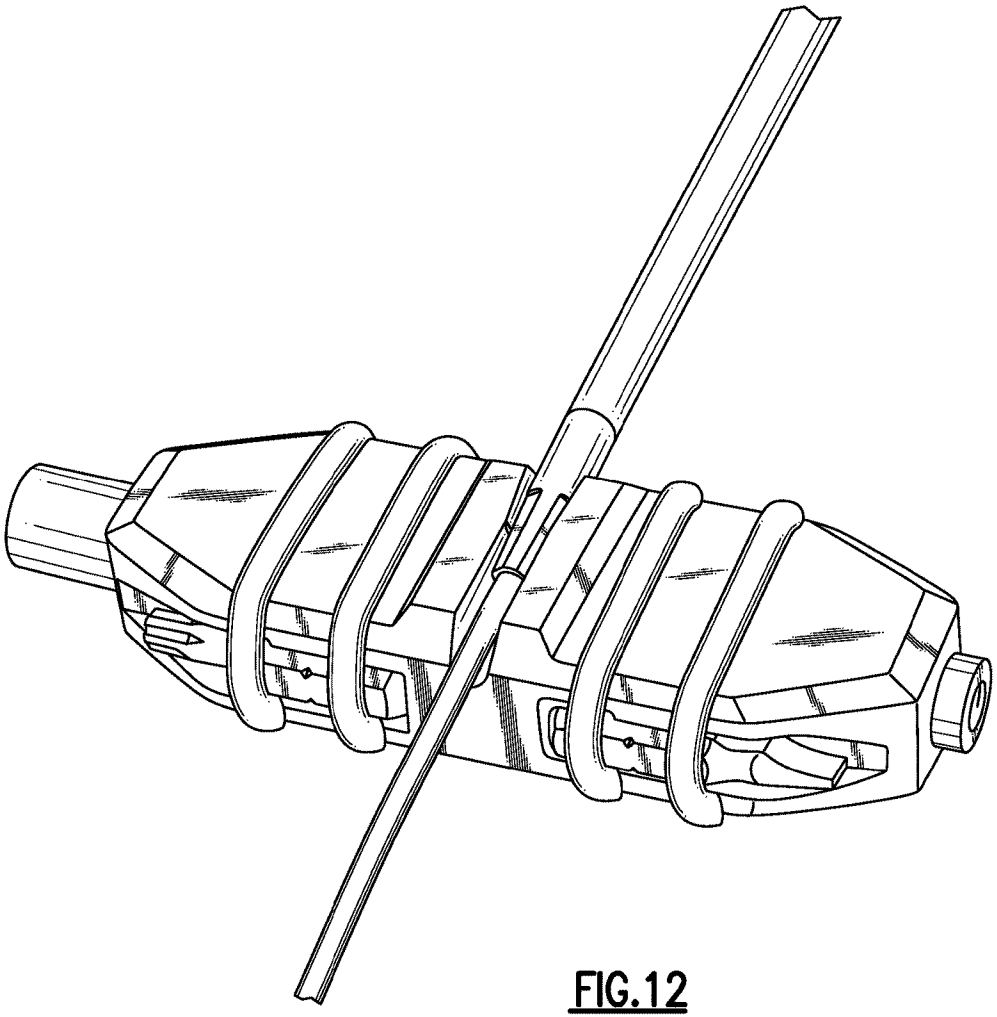
FIG. 12 shows a drawing of the T-handle firearm cleaning tool of FIG. 1 with the rod of FIG. 7A threadingly coupled to the cable of FIG. 4.
Figure 13:
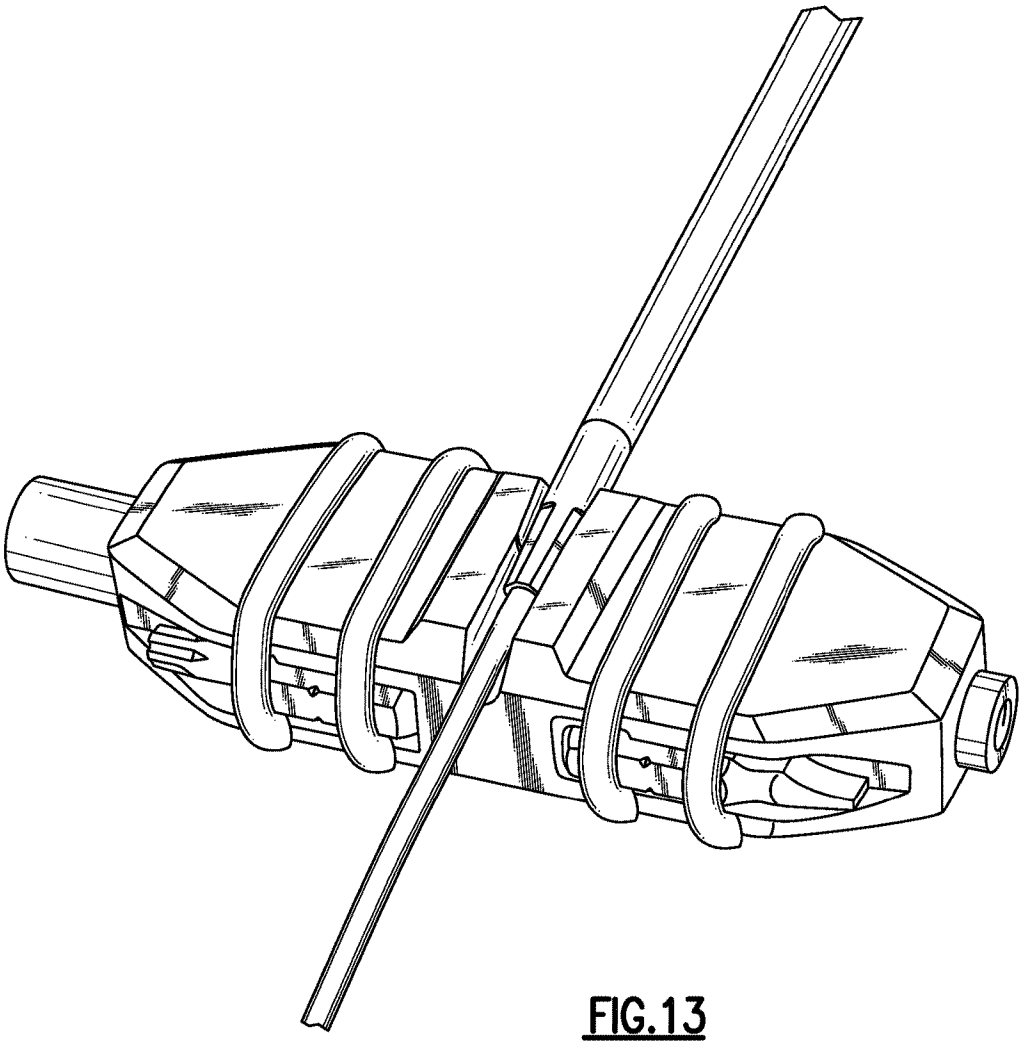
FIG. 13 shows another drawing of the T-handle firearm cleaning tool of FIG. 1 with the rod of FIG. 7A threadingly coupled connector, flexible cable, and slotted tip assembly of FIG. 4.

Alternatively, rod 301 can be threadingly coupled to the female threaded end of connector 211. FIG. 10 shows a drawing of the end of the cable next to the rod 301. FIG. 11 shows a drawing of the connector at end of the cable threadingly coupled to the threaded end of rod 301. In this T-handle firearm cleaning tool body 201 rod 301 configuration, connector 211 is disposed in tapered cavity 291 as before. However, as shown in FIG. 12, now T-handle firearm cleaning tool body 201 can be used to push rod 301 forward into an opening or cavity. FIG. 12 shows a drawing of the T-handle firearm cleaning tool of FIG. 1 with rod 301 threadingly coupled to the cable of FIG. 4. FIG. 13 shows another drawing of the T-handle firearm cleaning tool of FIG. 1 with rod 301 threadingly coupled connector, flexible cable, and slotted tip assembly of FIG. 4.

Figure 14:
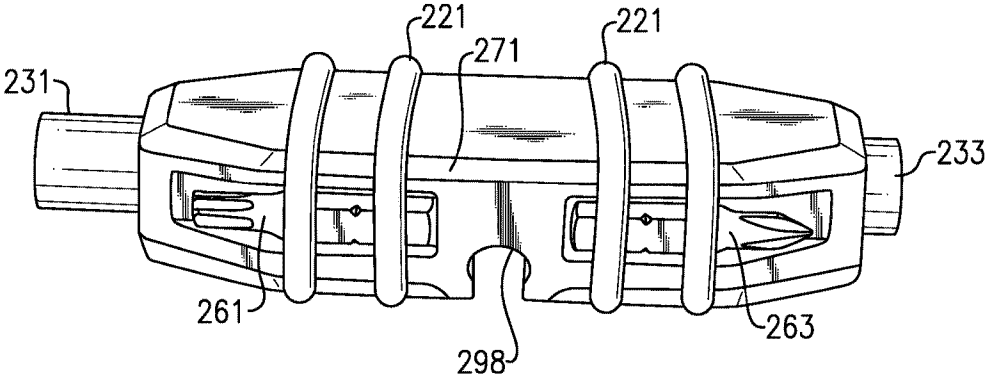
FIG. 14 shows a side view of the handle of the T-handle firearm cleaning tool of FIG. 1 in more detail.
Figure 15:
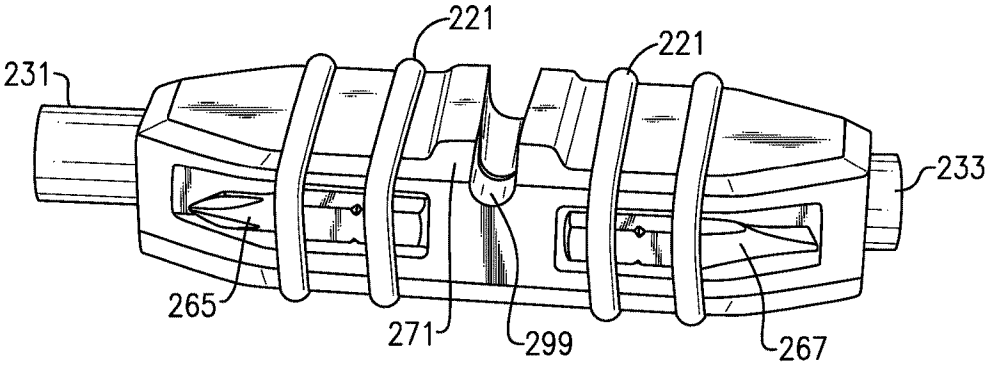
FIG. 15 shows the other side view of the handle of the T-handle firearm cleaning tool of FIG. 14.

FIG. 14 shows a side view of the handle of the T-handle firearm cleaning tool of FIG. 1 in more detail. FIG. 15 shows the other side view of the handle of the T-handle firearm cleaning tool of FIG. 1. In the exemplary embodiment of the drawings, the T-handle firearm cleaning tool body 201 includes ergonomic beveled edges 271 between the first surface 251, the second surface 253, and the sides 281, 283. Also seen in FIG. 14 and FIG. 15 are exemplary tool bits, Torx tool bit 261, #1 Philips tool bit 263, #2 Philips tool bit 265, and a flat head tool bit 267. Two O-rings 221 in channels further secure each of two tool bits on either side 281, 283 of the T-handle firearm cleaning tool body 201 into tool bit cavities. Also visible in FIG. 14 and FIG. 15 are a hex base tool bit receptacle 231 and a threaded female receptacle 233 which can threadingly accept rod 301 as described hereinabove.

Figure 16:
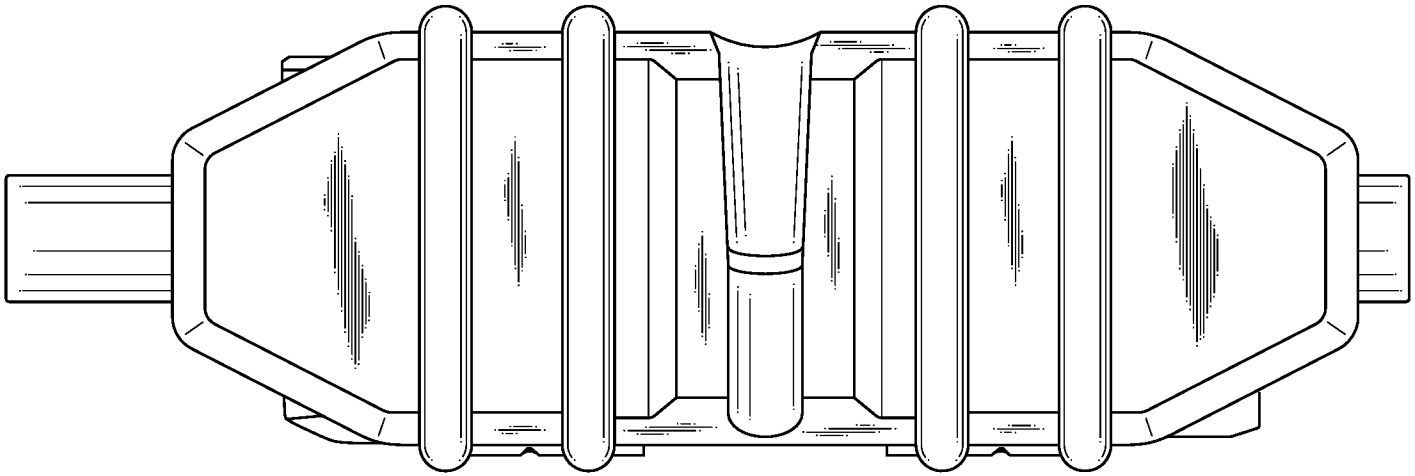
FIG. 16 shows a top view of the handle of the T-handle firearm cleaning tool of FIG. 1.

FIG. 16 shows a top view of the handle of the T-handle firearm cleaning tool of FIG. 1.

Figure 17:
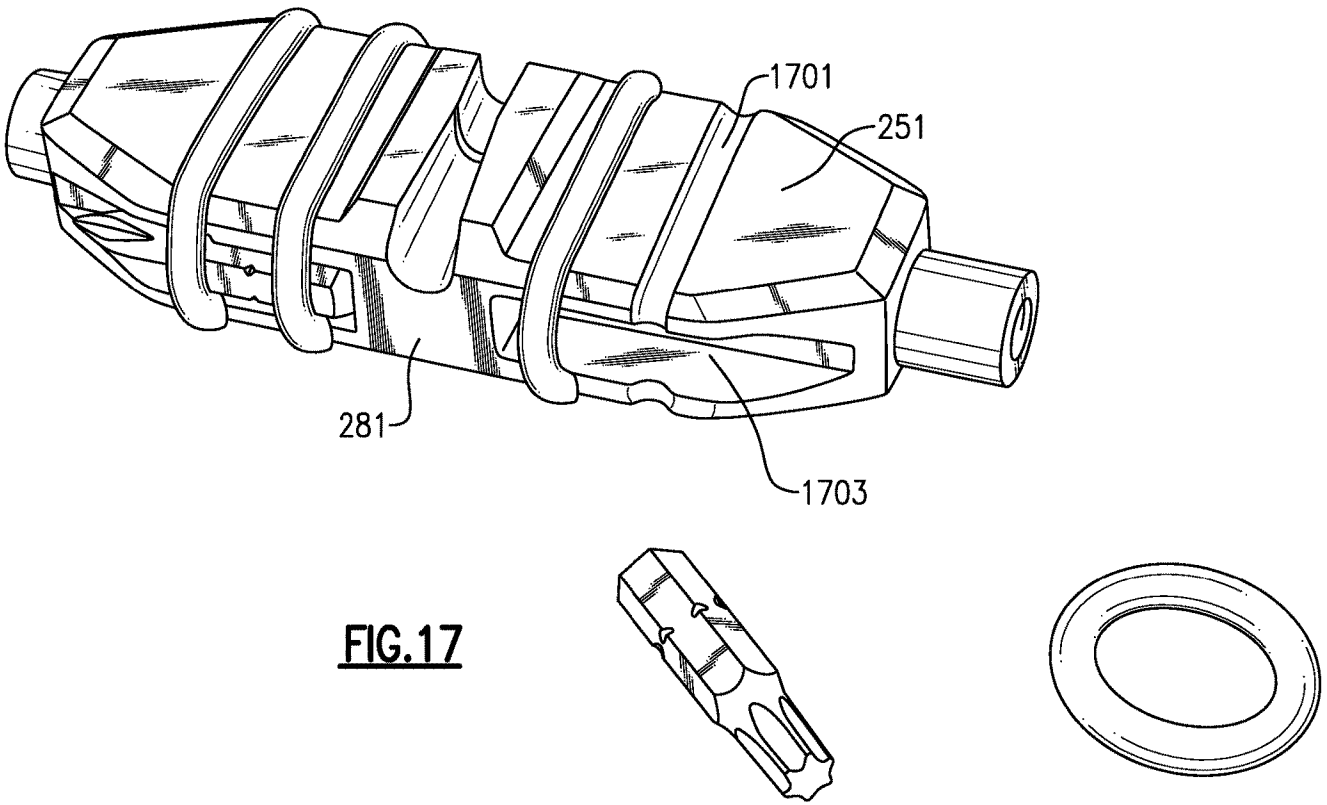
FIG. 17 shows an isometric view of the T-handle firearm cleaning tool of FIG. 1 with one O-ring band and one tool bit removed.
Figure 18:
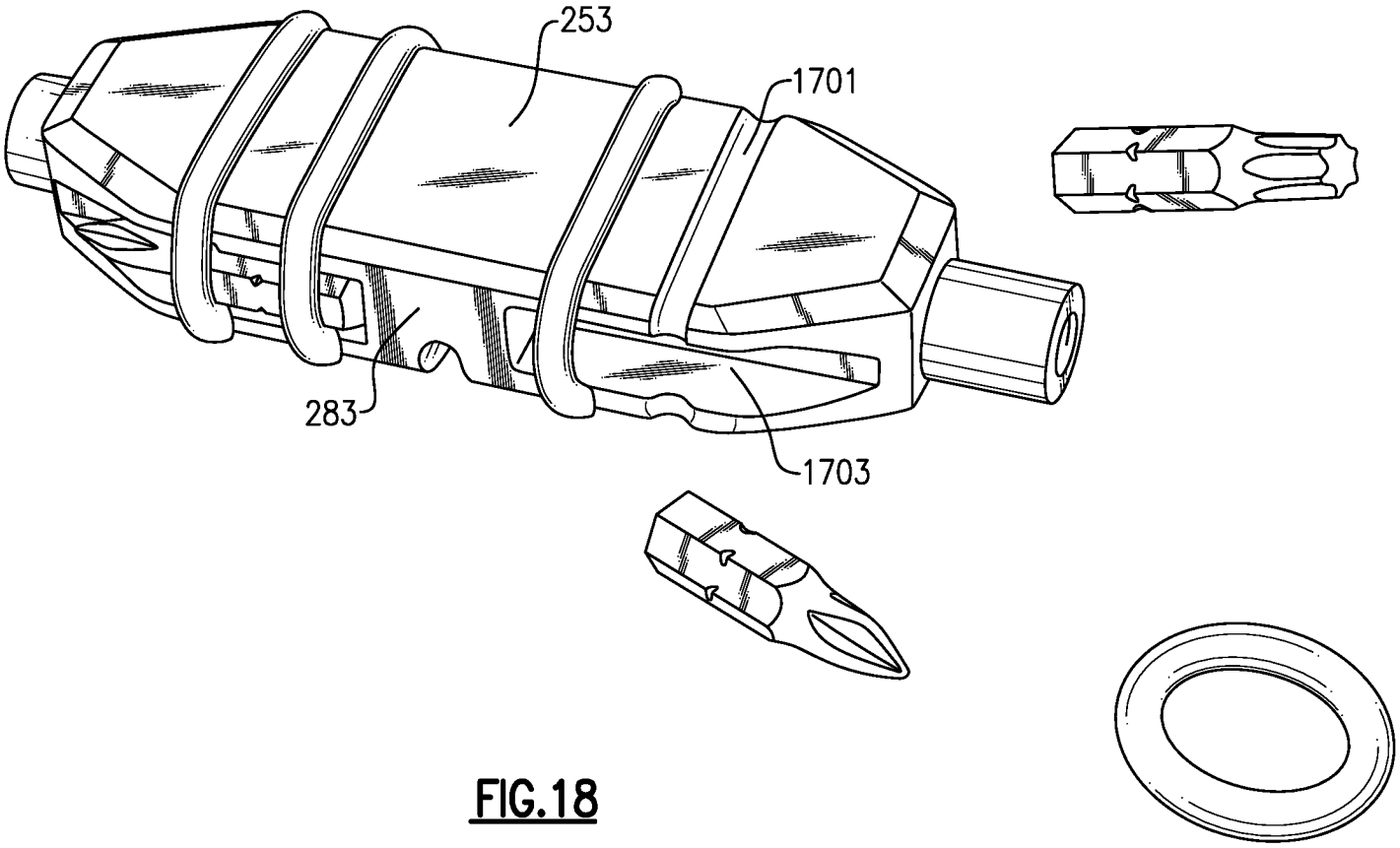
FIG. 18 shows another isometric view of the T-handle firearm cleaning tool of FIG. 1 with one O-ring band and two tool bits removed.

FIG. 17 shows an isometric view of the T-handle firearm cleaning tool of FIG. 1 with one O-ring 221 and one tool bit removed. With the O-ring 221, channel 1701 is visible, and with the exemplary Torx tool bit 261 removed, tool bit cavity 1703 is visible. FIG. 18 shows another isometric view of the T-handle firearm cleaning tool of FIG. 1 with one O-ring 221 band and two exemplary tool bits, Torx tool bit 261 and #2 Philips tool bit 265, removed from tool bit cavities 1703. In some embodiments one or more tool bit cavities are sized for an interference fit with the tool bit to hold the tool bit in the cavity.

In another embodiment, instead of the "O" rings or bands, the tool bit cavities can be undercut molded into the T-handle firearm cleaning tool body, to keep the bits in place. For example, there can be a hex undercut molded tool bit cavity.

Figures 28A, 28B, 28C, 28D, 28E, 28F, 28G:
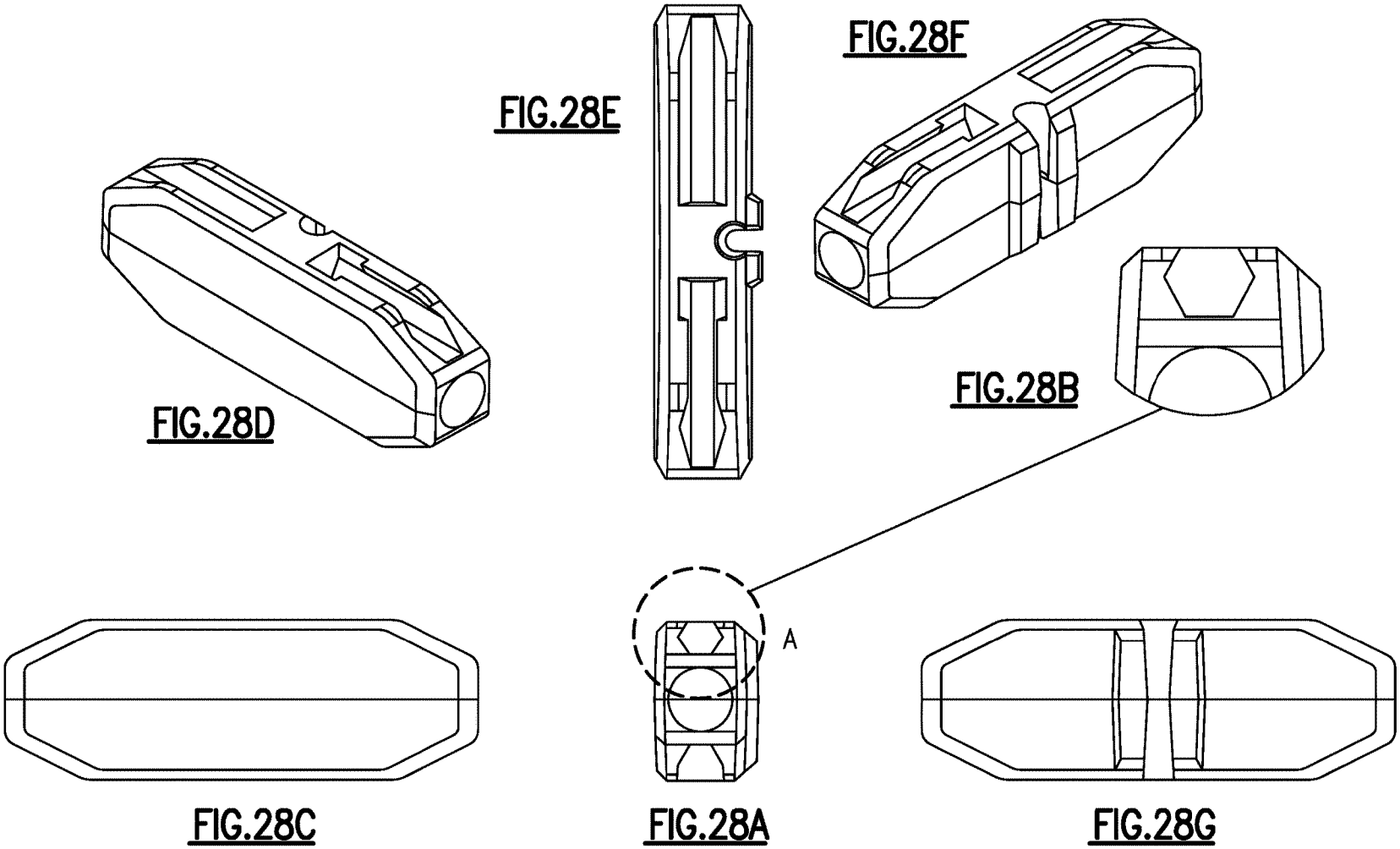
FIG. 28A is a drawing illustrating an end view of an exemplary T-handle firearm cleaning tool body where the tool bit cavities of the T-handle firearm cleaning tool body are undercut molded into T-handle firearm cleaning tool body to keep the bits in place.
FIG. 28B is a drawing illustrating a detail of the undercut tool cavity of FIG. 28A.
FIG. 28C is a drawing illustrating a bottom view of the T-handle firearm cleaning tool body of FIG. 28A.
FIG. 28D is a drawing illustrating an isometric view of the T-handle firearm cleaning tool body of FIG. 28A.
FIG. 28E is a drawing illustrating a side view of the T-handle firearm cleaning tool body of FIG. 28A.
FIG. 28F is a drawing illustrating another isometric view of the T-handle firearm cleaning tool body of FIG. 28A.
FIG. 28G is a drawing illustrating a top view of the T-handle firearm cleaning tool body of FIG. 28A.

FIG. 28A to FIG. 28G, for example, show a T-handle firearm cleaning tool body where the tool bit cavities of the T-handle firearm cleaning tool body are undercut molded into the T-handle firearm cleaning tool body to keep the bits in place. FIG. 28A is a drawing illustrating an end view of an exemplary T-handle firearm cleaning tool body where the tool bit cavities of the T-handle firearm cleaning tool body are undercut molded into the T-handle firearm cleaning tool body to keep the bits in place. FIG. 28B is a drawing illustrating a detail of the undercut tool cavity of FIG. 28A (e.g. a hex shaped undercut tool cavity). FIG. 28C is a drawing illustrating a bottom view of the T-handle firearm cleaning tool body of FIG. 28A. FIG. 28D is a drawing illustrating an isometric view of the T-handle firearm cleaning tool body of FIG. 28A. FIG. 28E is a drawing illustrating a side view of the T-handle firearm cleaning tool body of FIG. 28A. FIG. 28F is a drawing illustrating another isometric view of the T-handle firearm cleaning tool body of FIG. 28A. FIG. 28G is a drawing illustrating a top view of the T-handle firearm cleaning tool body of FIG. 28A.

Figure 19:
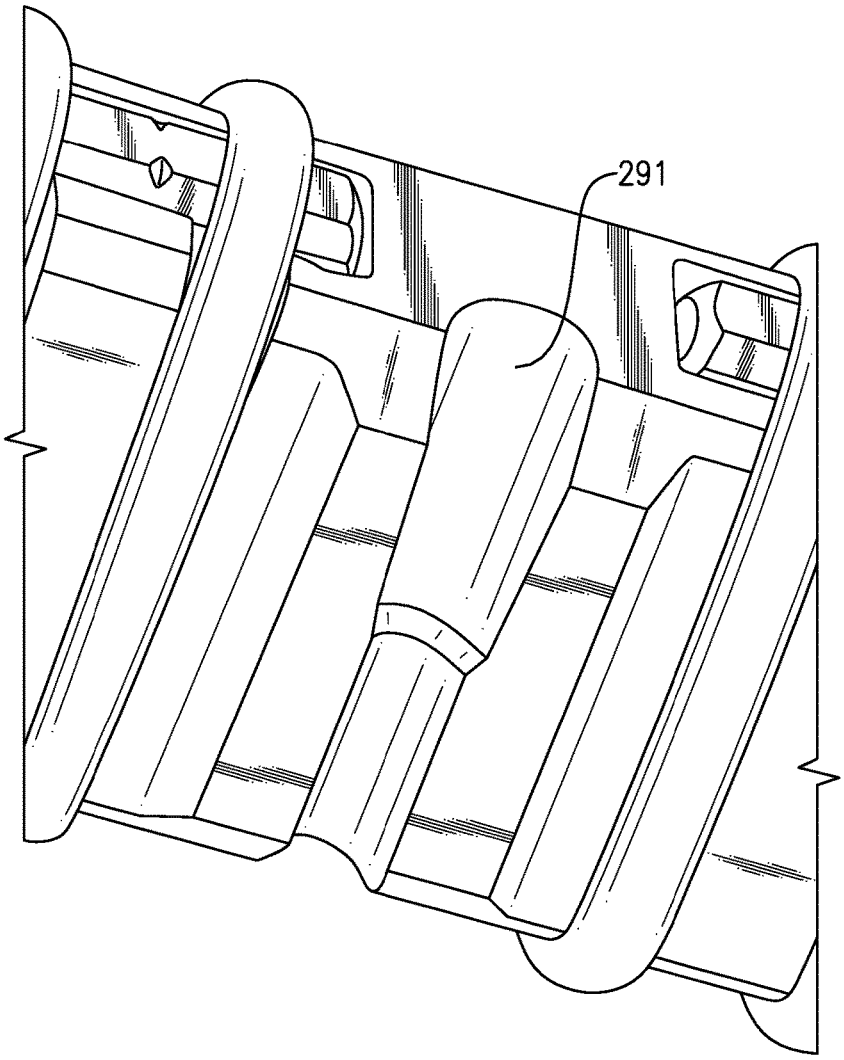
FIG. 19 shows more detail of the exemplary cable end connector receptacle of the T-handle of FIG. 1.

FIG. 19 shows more detail of the exemplary cable end connector receptacle 291 of the T-handle of FIG. 1.

Figure 20:
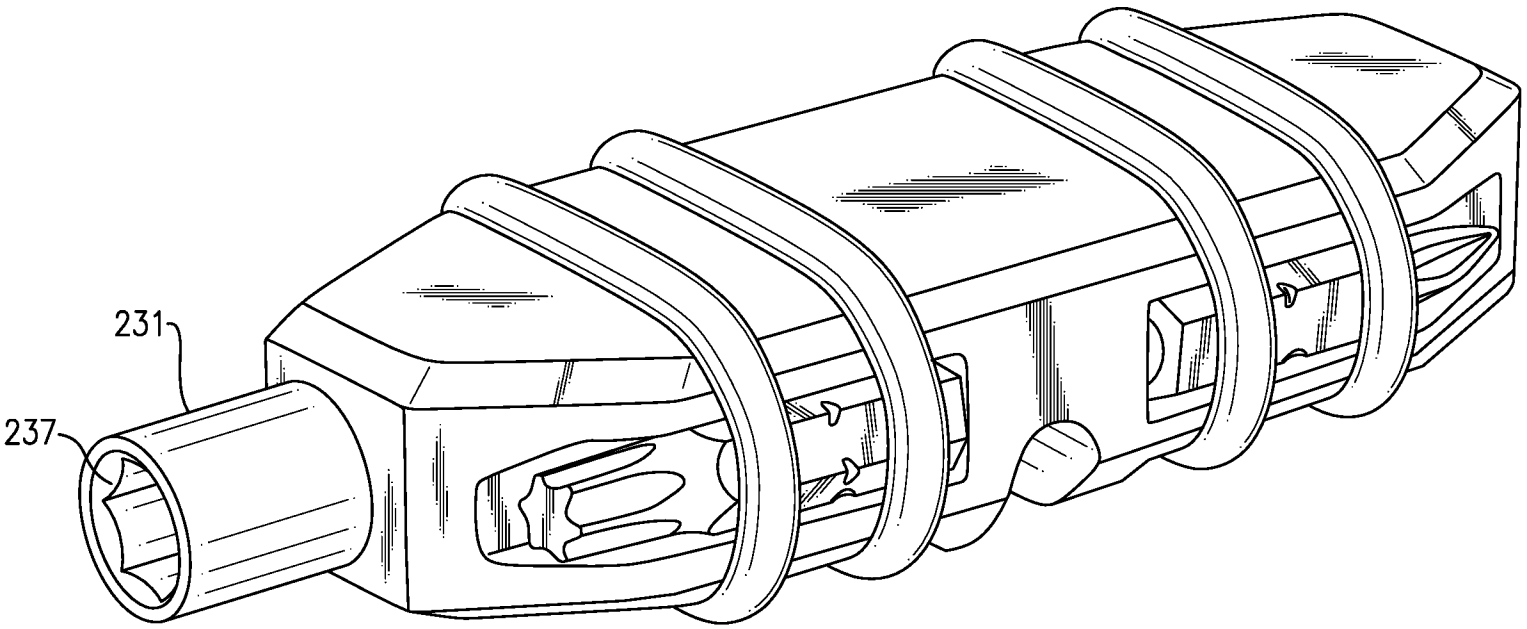
FIG. 20 shows an end view of the T-handle of FIG. 1 tool bit receptacle of FIG. 1.
Figure 21:
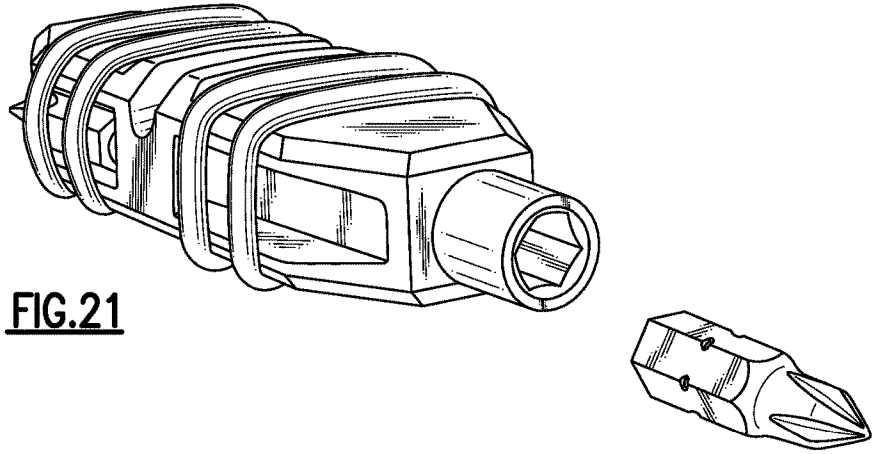
FIG. 21 shows a drawing of an end view of the T-handle of FIG. 1 next to an exemplary tool bit before the tool bit is inserted into the T-handle.

FIG. 20 shows an end view of the T-handle of FIG. 1 tool bit receptacle 231 of FIG. 1, here an exemplary hex tool bit receptacle sized to accept tool bits having a hex base. FIG. 21 shows a drawing of an end view of the T-handle of FIG. 1 next to an exemplary tool bit before the tool bit is inserted into the T-handle.

Figure 22:
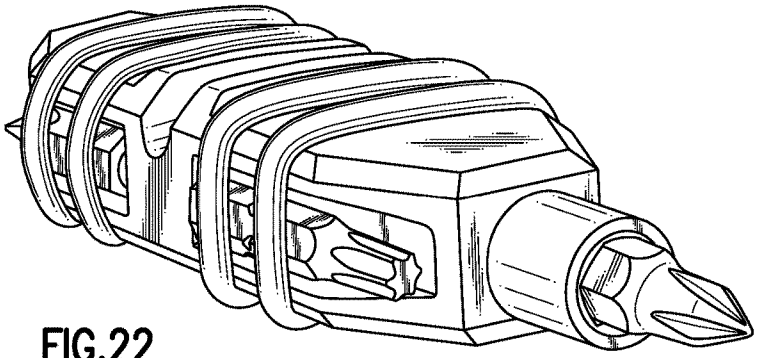
FIG. 22 shows a drawing of an end view of the T-handle of FIG. 21 with an exemplary tool bit inserted.

FIG. 22 shows a drawing of an end view of the T-handle of FIG. 1 with an exemplary tool bit inserted. In configurations such as the one illustrated by FIG. 22, T-handle firearm cleaning tool body 201 can serve as a tool handle.

Figure 23:
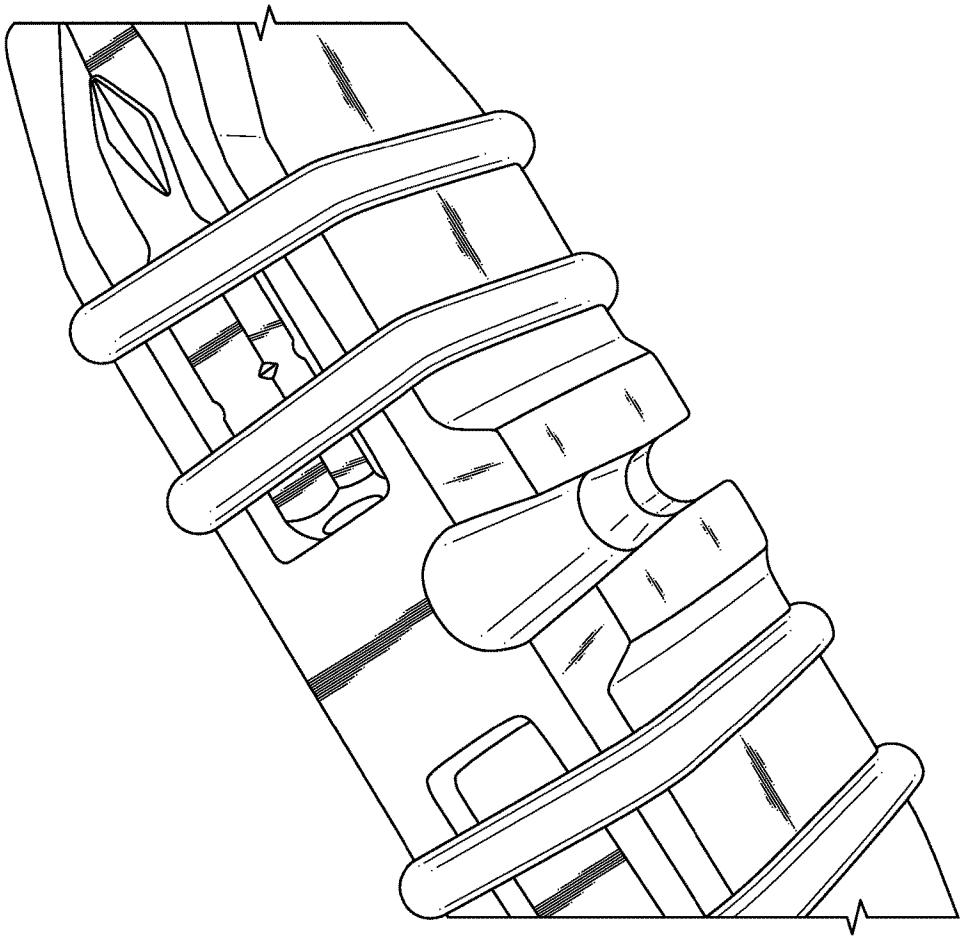
FIG. 23 shows an elevated side view drawing of the tapered connector opening.

FIG. 23 shows an elevated side view drawing of the tapered cavity 291, the tapered connector opening.

Figure 24:
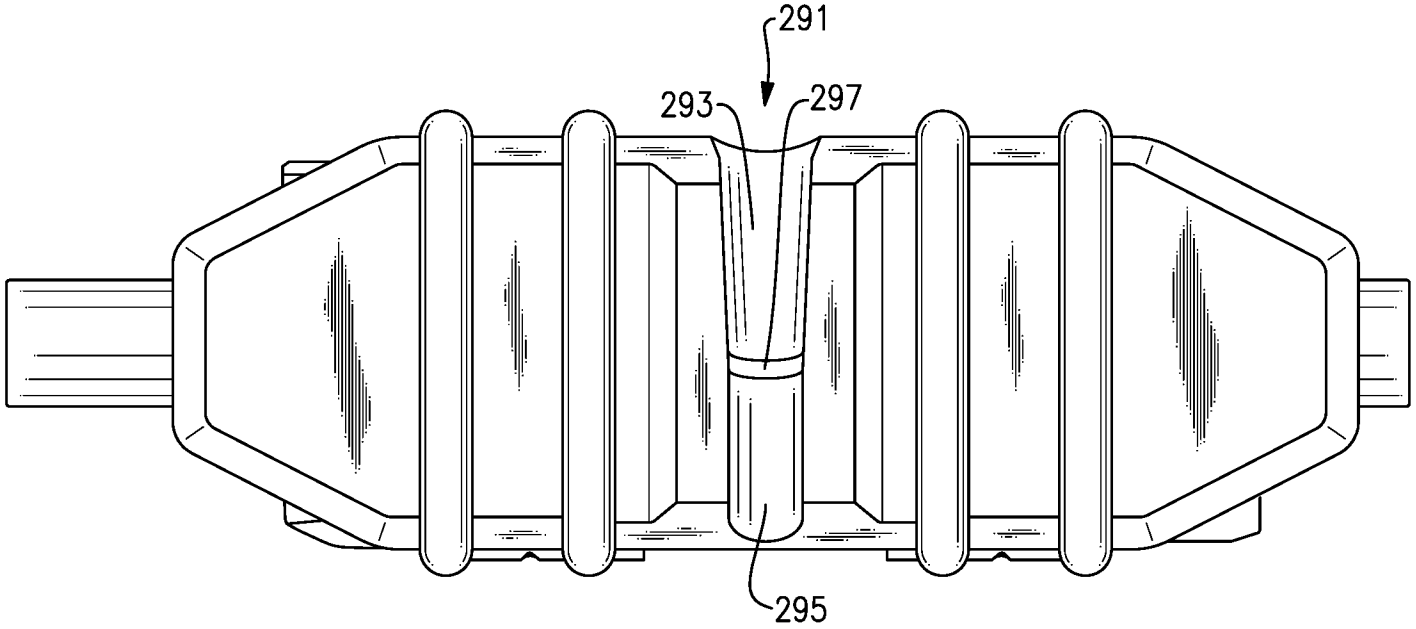
FIG. 24 shows a top view drawing of the tapered cavity and tapered cavity ridge.

FIG. 24 shows a top view drawing of the tapered cavity 291 in more detail. The exemplary tapered cavity 291 includes a larger opening 293 sized to accept the connector 211 or a cleaning tool bit, e.g. slotted bit 215, a ledge or ridge 297 sized to stop motion of the connector in one direction within the tapered cavity 291, and a smaller opening 295 to allow the flexible cable 213 to which the connector and tool bit is affixed to pass through the T-handle firearm cleaning tool body 201. The tapered cavity 291 can be seen to include tapered cavity openings 298, 299 (FIG. 14, FIG. 15) in each of two side surfaces of said T-handle firearm cleaning tool body.

The T-handle firearm cleaning tool body 201 can be made from any suitable material by any suitable manufacturing method. For example, it is contemplated that a T-handle firearm cleaning tool body 201 can be machined from any suitable material including a metal, such as, for example, an aluminum block or rectangular bar stock. However, more commonly, such as the exemplary tool of the drawings, the T-handle firearm cleaning tool body 201 can be made from, for example, ABS plastic (Acrylonitrile-butadiene-styrene copolymer), TPE, or PC (poly carbonate).

The T-handle firearm cleaning tool body can be made by any suitable manufacturing method. For example, the tool body can be injection molded, including injection molded with inserts. Where the body is made from a plastic or other polymer type material, such as, for example, elastomers, thermoplastics, polymers, and thermosetting polymers. one exemplary suitable method is manufacture by injection molding using one or more injection molding forms or casts.

The rod 301 can be cut and threaded from any suitable material. The exemplary rod 301 of the drawings was made from brass rod stock. Similarly, the exemplary female threaded receptacle 233 was also machined from brass stock.

The "O" rings 221 can be any suitable off-the-shelf O-ring of any suitable size to sit substantially yet manually removably within channels 1701 (FIG. 17, 18). Any suitable flexible and/or elastic bands can also be used.

Any suitable tool bit receptacle can be used. The exemplary hex tool bit receptacle 231 is a chrome plated steel.

Flexible cable 213 is typically a steel woven cable. Flexible cable 213 can also be a memory flexible cable types which can (typically reversibly) retain certain desired bends. Typically, the wires of the cable are made from steel, such as, for example, stainless steel, galvanized steel, or zinc coated steel. The cable can be made from a coated cable and can be, for example, a pre-assembled coated aircraft cable wire, or any other suitable commercially available pre-assembled coated cable wire which is well-known in the art.

Tool bits, such as exemplary tool bits, Torx tool bit 261, #1 Philips tool bit 263, #2 Philips tool bit 265, and a flat head tool bit 267 are widely available as pre-manufactured bits, made from any suitable material of sufficient strength, typically a type of steel metal.

Example: A T-handle firearm cleaning tool kit includes a T-handle firearm cleaning tool body 201 having a top surface 251, a bottom surface 253, at least two end surfaces, and at least two side surfaces 281, 283. The T-handle firearm cleaning tool body includes at least one tool bit (e.g. Torx tool bit 261, #1 Philips tool bit 263, #2 Philips tool bit 265, or flat head tool bit 267) having a tool bit base. At least one T-handle firearm cleaning tool bit cavity 1703 has an opening about a length of the tool bit ("about" includes the case where the tool bit cavity is shorter than the tool bit, such as, for example, where the tool bit sticks out at one end). At least one band (e.g. O-ring 221) encircles the T-handle firearm cleaning tool body over an opening of the at least one T-handle firearm cleaning tool bit cavity 1703. At least one tool bit receptacle 231 is disposed in a surface of the T-handle firearm cleaning tool, the at least one tool bit receptacle sized to accept the tool bit base (e.g. a hex receptacle sized to accept the hex base of the exemplary tool bits: Torx tool bit 261, #1 Philips tool bit 263, #2 Philips tool bit 265, and flat head tool bit 267). A tapered cavity 291 is disposed in either of the top surface 251 or the bottom surface 253, the tapered cavity 291 has a long tapered cavity axis substantially perpendicular to a longitudinal axis of the T-handle firearm cleaning tool body and a tapered cavity opening in each of two side 281, 283 surfaces to capture a cable or rod connector 211 (or, the cleaning tool 215, where cable assembly 203 is reversed) in at least one of a pull or push direction. The exemplary tapered cavity 291 includes a larger opening 293, a ledge or ridge 297 sized to stop motion of the connector in one direction within the tapered cavity 291, and a smaller opening 295.

Figure 25:
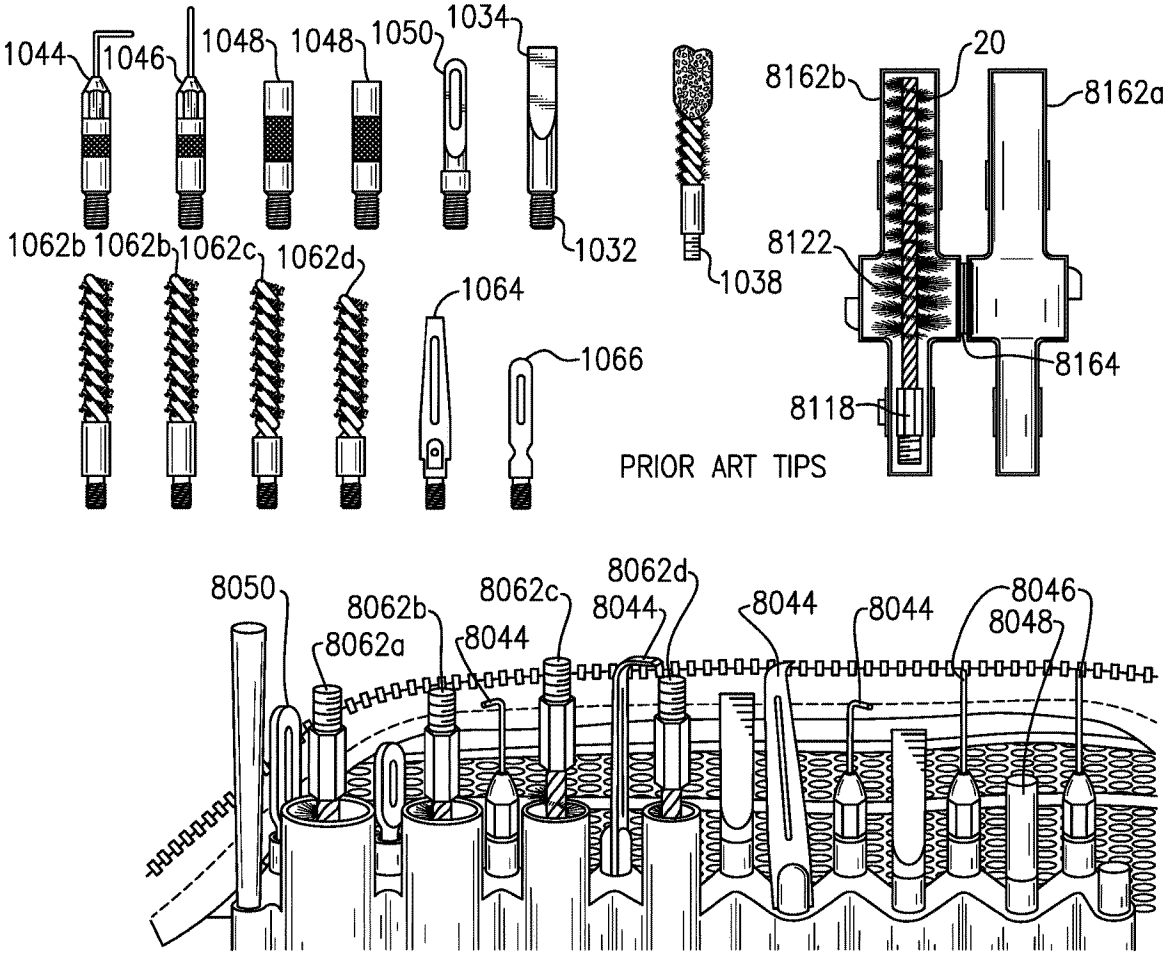
FIG. 25 shows drawings of a variety of cleaning tips which can be used with the cable or rod and the T-handle of FIG. 1.

FIG. 25 shows drawings of a variety of cleaning tips having a male threaded part which can be used with the female threaded receptacle of either the cable or the rod of a T-handle tool kit. For example, shown are exemplary brushes 1062*a*, 1062*b*, 1062*c*, 1062*d*, 1038, 20, 8062*a*, 8062*b*, 8062*c*, and 8062*d*. Dual tier brush 20 includes male threaded attachment 8118, and is shown in a case 8162*a* and 8162*b* which folds about hinge 8164. Also shown are slotted bits 1050, 1064, 1066, and 8044. Other miscellaneous cleaning bits include 1044, 1046, 1048, 1034, 8044 (several bits), 8046 (several bits), and 8048. The exemplary bits along the bottom of FIG. 25 are shown stored in a storage and carrying case of the prior art.

Figure 26:
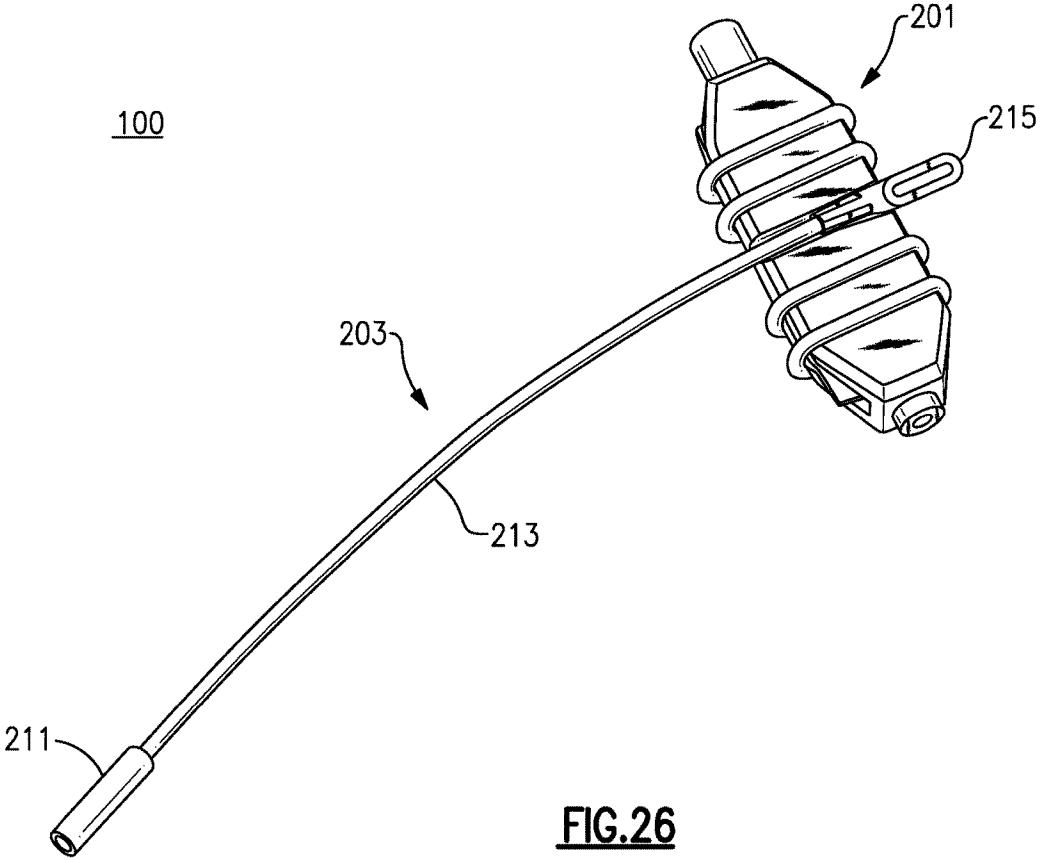
FIG. 26 shows a drawing of the T-handle firearm cleaning tool of FIG. 1 where the crimped connector of the slotted cleaning tip is captured by the tapered cavity.

Cable assembly 203 of FIG. 2 is reversible. FIG. 26 shows a drawing of the T-handle firearm cleaning tool of FIG. 1 where the crimped connector of the slotted cleaning tip is captured by the tapered cavity. In the configuration of FIG. 26, any suitable cleaning tip, such as, for example, those of FIG. 25 can be attached to the exemplary female threaded end 223 (threads 225) of a connector 211 crimped onto the flexible cable by crimp section 221 (see also, FIG. 5).

Figure 27:
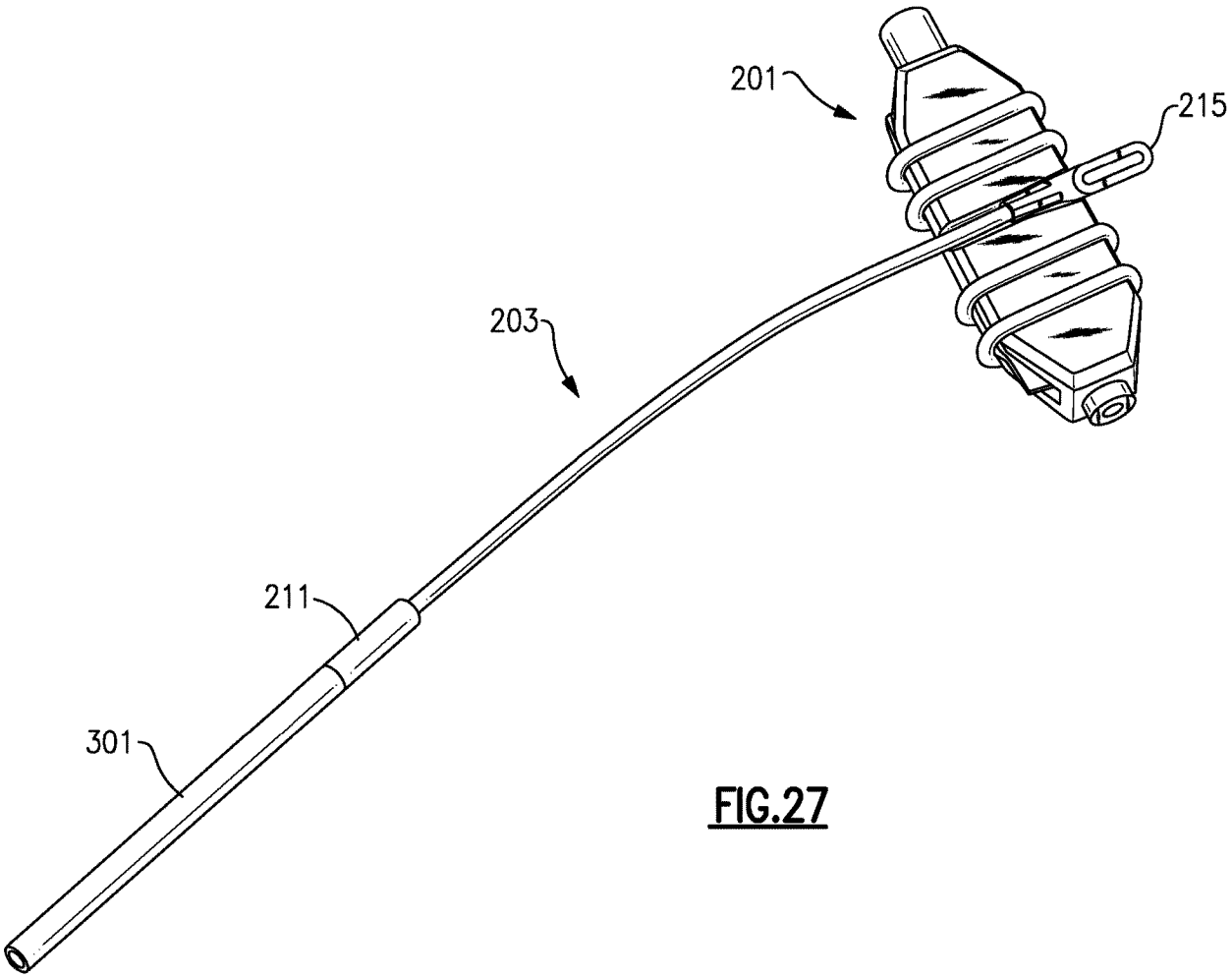
FIG. 27 shows a drawing of the T-handle firearm cleaning tool of FIG. 1 where the crimped connector of the slotted cleaning tip is captured by the tapered cavity and a rod is coupled to the female threaded connector as an extension of the flexible cable.

FIG. 27 shows a drawing of the T-handle firearm cleaning tool of FIG. 1 where the crimped connector of the slotted cleaning tip is captured by the tapered cavity and the rod 301 is coupled to the female threaded connector 211 as an extension of the flexible cable 203. There could similarly be another length of cable attached to the female threaded connector 211 as an extension of the flexible cable 203. In such manner, the T-handle firearm cleaning tool of FIG. 1 can also be configured to clean firearms with bores longer than those which can be accommodated by a flexible cable 203 alone.

There can be any suitable crimped tip or connector on the end of cable assembly 203 opposite to connector 211. Or, there could be two crimped cleaning tips, where the crimped cleaning tip is captured in the tapered cavity 291 of the T-handle firearm cleaning tool body 201, such as a connector 211.

Cable assembly 203 of FIG. 2 is exemplary of a cleaning tool tip which can be pulled through a bore of a firearm by a connector 211 disposed in a tapered cavity 291 of a T-handle firearm cleaning tool body 201. It is also contemplated that any suitable cable or rod based tool can be used a T-handle firearm cleaning tool body 201 having a tapered cavity 291. For example, while not as compact kit as described in the example herein above, a T-handle firearm cleaning tool body as described hereinabove could be used to pull any of the new types of cable based tools described in our recent patents, such as, for example, the cleaning tools of the '945 and '947 patents. More likely, because of the relatively compactness, a T-handle firearm cleaning tool body could be used to capture a cable with a tool bit, such as the slotted tool bit 215, and there could any suitable type of cleaning tool bit, such as for example, any suitable type of bore brush threadingly coupled to a connector, such as connector 211.

Just as the T-handle firearm cleaning tool body 201 can store tool bits in tool bit cavities 1703, it is also contemplated that some or all of the tool bit cavities could be replaced by cleaning bit cavities to store a cleaning bit in the T-handle firearm cleaning tool body. As well there could be additional supplemental tool bit or cleaning bit cavities disposed in any suitable surface of a T-handle firearm cleaning tool body. Any tool bit or cleaning bit cavities may have an interference fit with the intended tool bit or cleaning bit, a band (e.g. an O-ring) to hold the tool bit or cleaning bit in the cavity, or any combination thereof.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A T-handle firearm cleaning tool comprising:

a T-handle firearm cleaning tool body having a first surface and a second surface opposite said first surface and a T-handle firearm cleaning tool body longitudinal axis;

a flexible cable having a connector mechanically coupled to a first flexible cable end and a cleaning tool bit mechanically coupled to a second flexible cable end opposite said first flexible cable end;

a tapered cavity disposed in either of said first surface or said second surface, said tapered cavity having a tapered cavity long axis substantially perpendicular to said T-handle firearm cleaning tool body longitudinal axis, said connector and said cleaning tool bit sized to interference fit in said tapered cavity and said tapered cavity sized to capture said connector or said cleaning tool bit in said tapered cavity; and wherein said tapered cavity comprises a tapered cavity opening in each of two side surfaces of said T-handle firearm cleaning tool body.

2. The T-handle firearm cleaning tool of claim 1, wherein said tapered cavity further comprises a ridge or a ledge within said tapered cavity to substantially prevent motion of said flexible cable past said ridge or ledge in at least one of a pull or push direction.

3. The T-handle firearm cleaning tool of claim 1, wherein said T-handle firearm cleaning tool body comprises at least one T-handle firearm tool bit cavity having an opening sized to store a tool bit in said T-handle firearm cleaning tool body.

4. The T-handle firearm cleaning tool of claim 3, wherein said T-handle firearm cleaning tool further comprises at least one band encircling said T-handle firearm cleaning tool body over said opening of said at least one T-handle firearm tool bit cavity.

5. The T-handle firearm cleaning tool of claim 3, wherein said T-handle firearm cleaning tool body further comprises at least one channel and at least one O-ring is captured within said at least one channel and encircles said T-handle firearm cleaning tool body over said opening of said at least one T-handle firearm tool bit cavity to secure said tool bit into said T-handle firearm tool bit cavity.

6. The T-handle firearm cleaning tool of claim 1, wherein said T-handle firearm cleaning tool body comprises an undercut molded tool bit cavity.

7. The T-handle firearm cleaning tool of claim 1, wherein said T-handle firearm cleaning tool body comprises four T-handle firearm tool bit cavities on either end of each of two sides of said T-handle firearm cleaning tool body, each tool bit cavity having an opening sized to store a tool bit at each corner of four corners of said T-handle firearm cleaning tool body.

8. The T-handle firearm cleaning tool of claim 1, wherein said T-handle firearm cleaning tool body comprises at least one T-handle firearm tool bit receptacle to interchangeably accept tool bits.

9. The T-handle firearm cleaning tool of claim 8, wherein said T-handle firearm tool bit receptacle comprises a hex tool bit receptacle.

10. The T-handle firearm cleaning tool of claim 1, wherein said connector comprises a threaded connector crimped onto said flexible cable.

11. The T-handle firearm cleaning tool of claim 1, wherein said cleaning tool bit comprises a slotted bit which accepts a cleaning swab or a cleaning patch.

12. The T-handle firearm cleaning tool of claim 1, comprising at least four tool bit cavities disposed near each of four corners of said T-handle firearm cleaning tool body, each cavity being disposed respectively in a forward first side surface, a rear first side surface, a forward second side surface, a rear second side surface and wherein each tool bit cavity is also open to first and second ends of said T-handle firearm cleaning tool body.

13. The T-handle firearm cleaning tool of claim 12, wherein said tool bit cavity is disposed in an end surface of at least two end surfaces of said T-handle firearm cleaning tool body.

14. The T-handle firearm cleaning tool of claim 1, further comprising a female threaded socket in at least one surface of said T-handle firearm cleaning tool body to accept a male threaded rod end of a cleaning rod.

15. The T-handle firearm cleaning tool of claim 14, wherein said cleaning rod further comprises a female threaded receptacle at an end of said cleaning rod opposite said male threaded rod end to accept a cleaning tool bit.

16. The T-handle firearm cleaning tool of claim 15, wherein said cleaning tool bit comprises a brush or an obstruction remover bit.

* * * * *